US005352004A

United States Patent [19]

Nedbal

[11] Patent Number: 5,352,004

[45] Date of Patent: Oct. 4, 1994

[54] GASKET RIB LOCK FOR DOOR HANDLE ASSEMBLY

[75] Inventor: Ralph G. Nedbal, St. Charles, Ill.

[73] Assignee: Illinois Tool Works Inc., Glenview, Ill.

[21] Appl. No.: 112,125

[22] Filed: Aug. 26, 1993

[51] Int. Cl.[5] ..... E05B 1/00

[52] U.S. Cl. ..... 292/347; 292/DIG. 31; 49/489.1

[58] Field of Search ..... 292/113, 247, 337, 347, 292/DIG. 31, DIG. 71; 49/502, 489.1

[56] References Cited

U.S. PATENT DOCUMENTS

| | | | |
|---|---|---|---|
| 3,153,553 | 10/1964 | Sandor | 292/DIG. 31 X |
| 3,381,988 | 5/1968 | Dewar | 49/489.1 X |
| 3,930,656 | 1/1976 | Jelinek | 277/180 |
| 4,232,892 | 11/1980 | Kuki | 292/347 |
| 4,412,696 | 11/1983 | Ishii et al. | 292/336.3 |
| 4,475,415 | 10/1984 | Yamamoto | 74/543 |
| 4,475,754 | 10/1984 | Arlauskas et al. | 292/336.3 |
| 4,482,179 | 11/1984 | Johnson | 292/336.3 |
| 4,635,946 | 1/1987 | Stanley | 277/134 |
| 4,653,143 | 3/1987 | Ketelhut | 16/124 |
| 4,681,357 | 7/1987 | Vemura et al. | 292/336.3 |
| 4,883,296 | 11/1989 | Laurie | 292/336.3 |
| 4,892,342 | 1/1990 | Newman et al. | 292/347 |
| 5,183,302 | 2/1993 | Pelachyk et al. | 292/336.3 |
| 5,248,175 | 9/1993 | Burns | 292/347 |

FOREIGN PATENT DOCUMENTS 2123904 2/1984 United Kingdom .

*Primary Examiner*—Rodney M. Lindsey
*Attorney, Agent, or Firm*—Schwartz & Weinrieb

[57] ABSTRACT

An arrangement for mounting a gasket to a vehicle door handle housing is provided whereby the gasket and the housing can be easily and rapidly assembled together without requiring the use of a separate fastening operation. The handle housing is provided with grooves, and the gasket is provided with rib members. The rib members are adapted so as to be press fitted into the grooves so as to securely mount the gasket to the housing.

24 Claims, 2 Drawing Sheets

Fig. 1
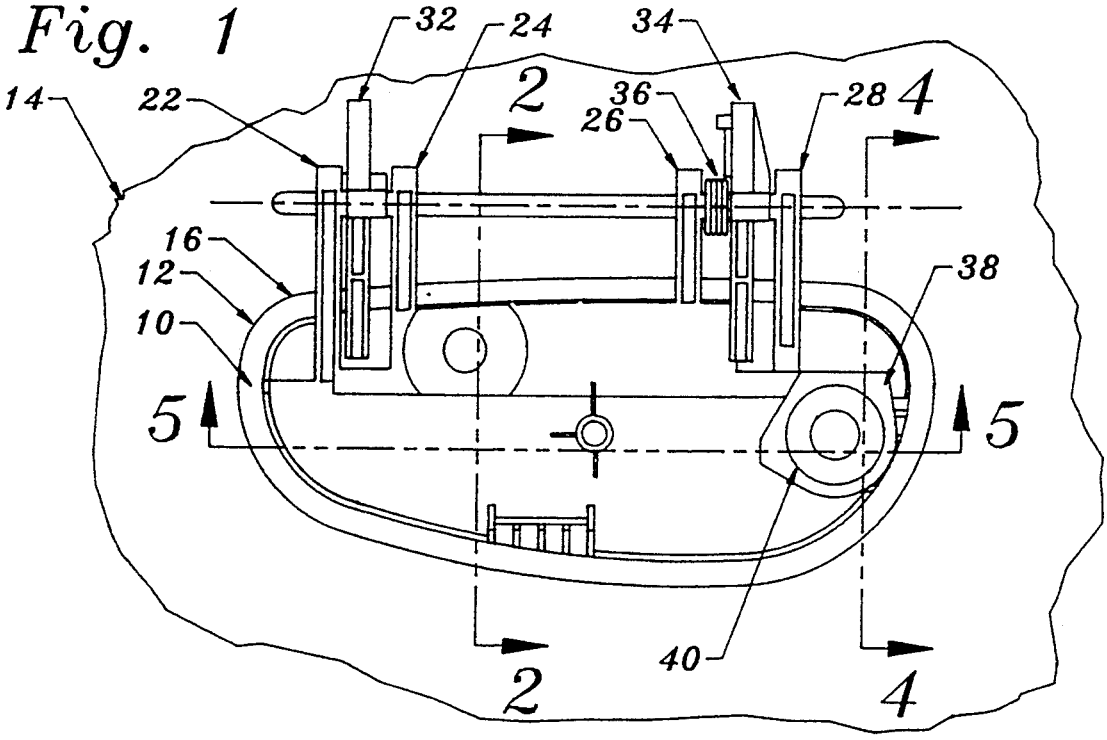
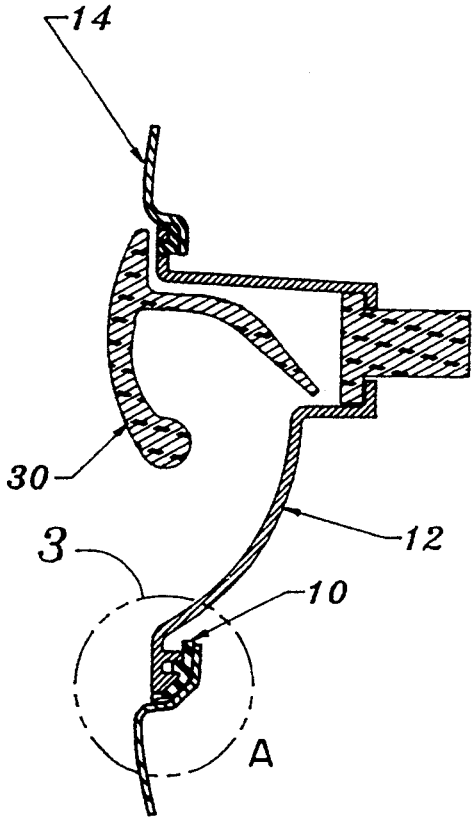
Fig. 2
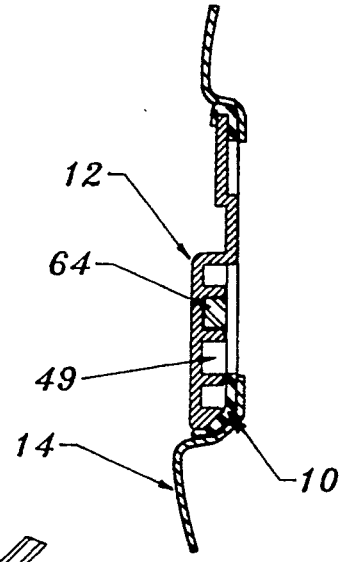
Fig. 4
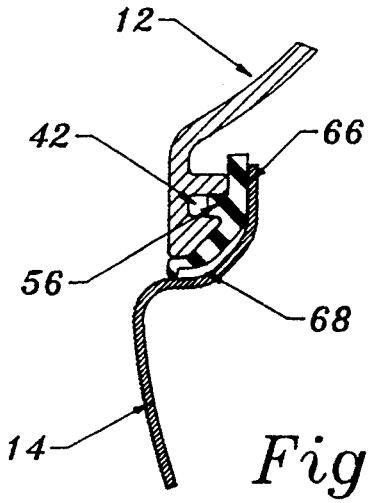
Fig. 3

Fig. 8
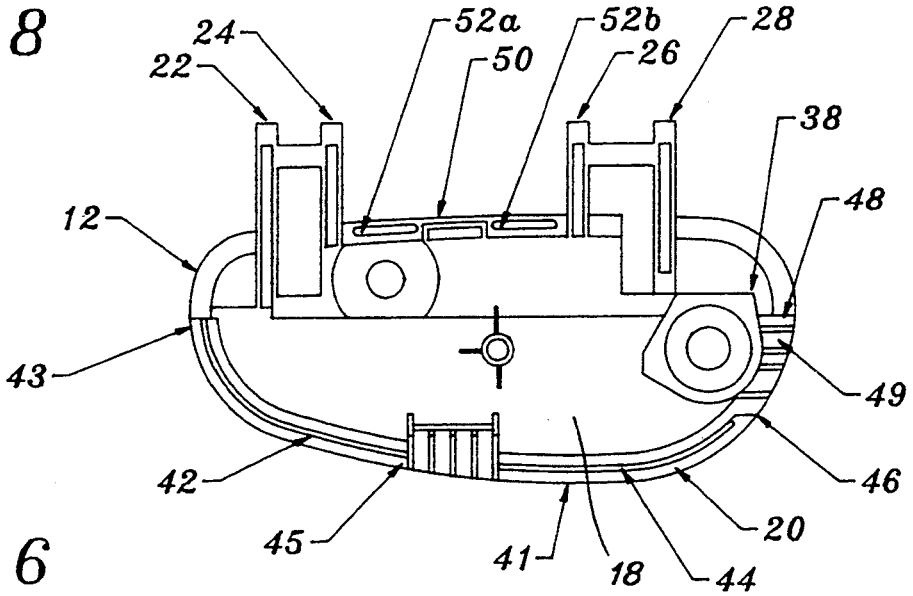
Fig. 6
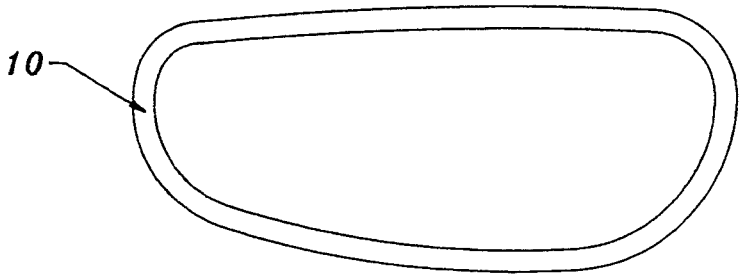
Fig. 7
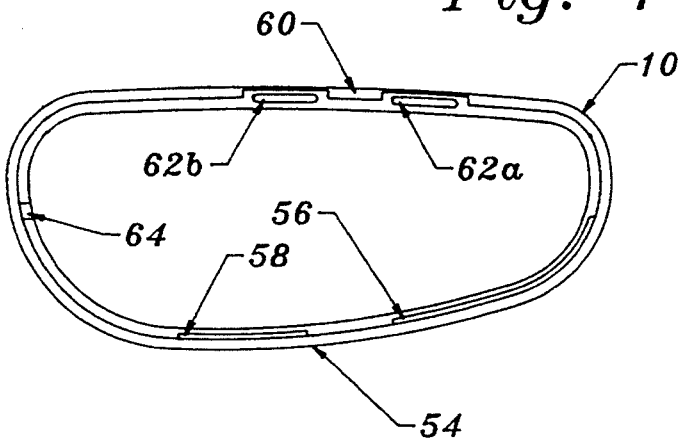
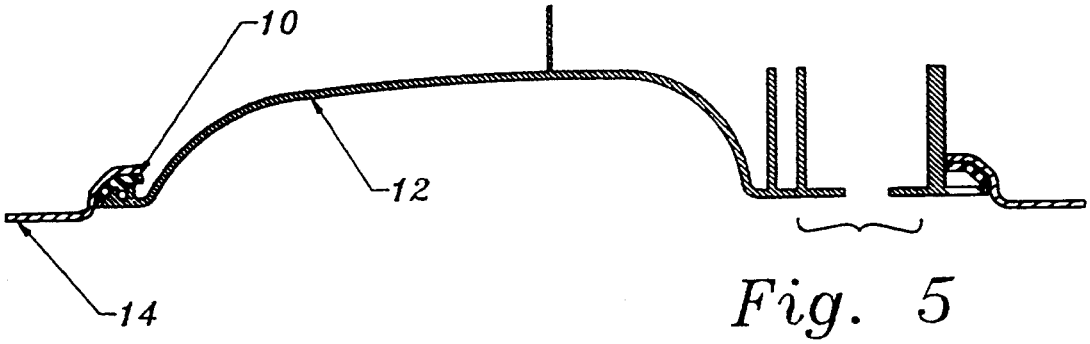
Fig. 5

GASKET RIB LOCK FOR DOOR HANDLE ASSEMBLY

BACKGROUND OF THE INVENTION

1. Field of the Invention

This invention relates generally to vehicle door handle assemblies and more particularly, it relates to an improved arrangement for mounting a gasket to a vehicle door handle housing without requiring the use of a separate fastening operation.

2. Description of the Prior Art

As is generally well-known in the art of motor vehicles, a vehicle door is generally constructed with a stamped metal door panel having an opening therein and a door handle assembly having a housing is inserted into the opening for attachment to the panel. A sealing member of some type such as a gasket is typically employed between the outer surface of the door panel opening and the edges of the door handle housing so as to effect a seal therebetween. However, glue or other adhesive material is usually required and is generally applied in a separate fastening operation.

Accordingly, it would be desirable to provide a gasket and a door handle housing which may be attached together without the necessity of a separate fastening operation, such as applying glue or other adhesive material.

A prior art search directed to the subject matter of this application in the U.S. Patent and Trademark Office revealed British Patent No. 2,123,904 and the following U.S. Pat. Nos.:

3,930,656
4,232,892
4,412,696
4,475,415
4,475,754
4,482,179
4,635,946
4,653,143
4,681,357
4,883,296
4,892,342
5,183,302

In U.S. Pat. No. 4,653,143 to Robert W. Ketelhut et al., issued on Mar. 31, 1987, there is disclosed a vehicle door handle assembly which includes a gasket assembly of a rectangular shape. The gasket assembly has a gasket member 72 which fits between the rib formation 24 of an escutcheon 22 and the inwardly offset flange 74 of the door panel 10. The gasket member further includes a pair of integral inwardly extending flaps 76 for covering the space between the opening 28 of the escutcheon and a pair of U-shaped portions 78 for fitting over the edges of the escutcheon.

In U.S. Pat. No. 4,475,754 to Alfonsas Arlauskas et al. issued on Oct. 9, 1984, there is disclosed a pull out type door handle assembly which includes a mounting member 12 for attaching to a vehicle door. A sealing gasket 34 is provided which extends around the wall 20 adjacent the periphery of the mounting member 12 so as to seal the member to the door panel 22.

In U.S. Pat. No. 4,482,179 to James J. Johnson issued on Nov. 13, 1984, there is taught a pull out type of door handle which includes a mounting member 12 formed of a continuous rib 24 and a pair of L-shaped inwardly extending flanges 26. The rib 24 and the flanges 26 together fit within an aperture 26 formed in a door panel 22. A peripheral gasket 30 is used to cushion the rib and flanges against the surface of the door panel 22.

In U.S. Pat. No. 4,883,296 to Stephen A. Laurie issued on Nov. 28, 1989, there is taught a vehicle door handle assembly comprised of a handle 1 pivotally connected to a base plate 2. The base plate is connected to a door panel 25 on which the handle is to be mounted. A gasket 4 is fitted around the base plate so as to protect the paint on the door panel 25.

The remaining patents uncovered from the search but not specifically discussed are merely cited to generally show the state of the art and are directed to automotive door handle assemblies and various types of gasket devices.

None of the prior art uncovered in the search disclosed an arrangement for mounting a gasket to a vehicle door handle housing like that of the present invention which does not require the use of a separate fastening operation. This is accomplished in the present invention by providing rib members on the gasket which are adapted to be press fitted into corresponding grooves formed in the vehicle door handle housing.

OBJECTS OF THE INVENTION

Accordingly, it is a general object of the present invention to provide an improved arrangement for mounting a gasket to a vehicle door handle housing which is relatively simple and economical to manufacture and assemble.

It is an object of the present invention to provide an improved arrangement for mounting a gasket to a vehicle door handle housing wherein the gasket can be mounted upon the door handle housing without requiring the use of a separate fastening operation.

It is another object of the present invention to provide an improved arrangement for mounting a gasket to a vehicle door handle housing wherein the mounting operation can be performed in an easy and rapid manner.

It is still another object of the present invention to provide an improved arrangement for mounting a gasket to a vehicle door handle housing which includes rib members formed on the gasket which are adapted to be press fitted into corresponding grooves formed in the handle housing.

SUMMARY OF THE INVENTION

In accordance with these aims and objectives, the present invention is concerned with the provision of an arrangement for mounting a gasket to a vehicle door handle housing which includes a vehicle door handle housing and a gasket. The handle housing is formed of a body portion and a terminal lip portion which surrounds the peripheral edge of the body portion. The handle housing further includes grooves formed in the body portion adjacent the terminal lip portion. The gasket includes rib members which are dimensioned and contoured so as to tightly engage with the grooves for securely mounting the gasket to the door handle housing.

BRIEF DESCRIPTION OF THE DRAWINGS

These and other objects and advantages of the present invention will become more fully apparent from the following detailed description when read in con-junction with the accompanying drawings with like reference numerals indicating corresponding parts throughout the several views, wherein:

FIG. 1 is a side elevational view of a vehicle door handle housing and a gasket attached thereto, constructed in accordance with the principles of the present invention;

FIG. 2 is a cross-sectional view, taken along the lines 2—2 of FIG. 1;

FIG. 3 is an enlarged view of the encircled area A of FIG. 2;

FIG. 4 is a cross-sectional view, taken along the lines 4—4 of FIG. 1;

FIG. 5 is a cross-sectional view, taken along the lines 5—5 of FIG. 1;

FIG. 6 is a front elevational view of the gasket of the present invention;

FIG. 7 is a rear elevational view of the gasket; and

FIG. 8 is a front elevational view of the door handle housing of FIG. 1, with all of the components removed for the sake of clarity.

DESCRIPTION OF THE PREFERRED EMBODIMENT

Referring now in detail to the drawings, there is shown in FIG. 1 an improved arrangement of the present invention for mounting a gasket 10 to a vehicle door handle housing 12. A portion of a vehicle door panel 14, which is conventionally stamped from sheet material, is also shown in FIG. 1. The door panel includes a recess 16 for receiving and mounting the handle housing 12 with the gasket 10 attached thereto. The present invention is concerned with the manner in which the gasket 10 is securely attached to the handle housing 12 without the use of a separate fastening operation, such as applying glue or other adhesive material to the gasket.

The vehicle door handle housing 12 is formed of an elliptically-shaped body portion 18 and an integral terminal lip portion 20 which extends around the peripheral edge of the body portion. The handle housing 12 is preferably formed of a plastic material by a conventional injection molding process. The handle housing further includes a first pair of upwardly extending crank arms 22, 24 and a second pair of upwardly extending crank arms 26, 28. The first crank arms 22 and 24 are disposed in a relatively close parallel relationship adjacent one end of the housing, and the second crank arms 26 and 28 are disposed also in a parallel relationship, but at a slightly increased spacing, adjacent the other end of the housing.

A handle 30 (FIG. 2) is integrally formed with a first lever arm 32 and a second lever arm 34. The first lever arm 32 is pivotally supported between the crank arms 22, 24, and the second lever arm 34 is pivotally supported between the crank arms 26, 28. The handle 30 is rotatable in the clockwise direction, as viewed from FIG. 2, against the biasing force of a helical spring 36 disposed between the second crank arms in order to actuate a door latch mechanism (not shown) for opening the vehicle door. The handle housing also includes an integral cylindrically-shaped hollow socket portion 38 disposed adjacent the other end of the housing for receiving a door lock cylinder 40.

Prior to placing the door housing 12 against the door panel 14 so that it overlies the door panel adjacent the periphery of the recess 16, the gasket 10 is securely mounted to the housing 12 adjacent the terminal lip portion 20 thereof. As can best be seen from FIG. 8, the lower peripheral edge 41 of the body portion 18 adjacent the lip portion thereof is provided with a first arcuate-shaped groove 42 which extends substantially between the intermediate left side edge 43 and the center of the bottom edge 45 of the body portion. A second elongated groove 44 is provided which extends substantially between the center of the bottom edge 45 of the body portion and the right side edge 46.

It will be noted that the right side edge of the body portion includes a plurality of parallel, spaced-apart ledges 48 having openings 49 formed therebetween. Further, the upper peripheral edge 50 of the body portion is formed with a pair of substantially rectangularly-shaped cut-outs 52*a* and 52*b*. The grooves 42, 44; openings 49; and cut-outs 52*a*, 52*b* are adapted to contact or engage certain portions of the gasket, as shown in FIGS. 2–7, for secure attachment therewith in a rapid and easy manner without the need of glue, other adhesive material and the like.

The gasket 10 of the present invention is formed of a substantially elliptically-shaped configuration which is dimensioned and contoured so as to cooperatively engage with the terminal lip portion 20 of the body portion of the handle housing. The gasket 10 is preferably formed of an elastomeric material, such as rubber. Adjacent the bottom edge 54 of the gasket 10, there is provided an arcuate-shaped rib member 56 which is dimensioned and contoured so as to press fit into the first groove 42 formed in the body portion of the handle housing 12. There is also formed an elongated rib member 58 which is dimensioned and contoured so as to press fit into the second groove 44 of the housing.

Further, the top edge 60 of the gasket 10 is formed with a pair of rectangularly-shaped rib members 62*a*, 62*b* which are dimensioned and contoured so as to be insertable into the respective cut-outs 52*a*, 52*b* in the body portion of the housing for producing a tight contact engagement therewith. Accordingly, it will be understood that the rib members 56, 58, 62*a*, 62*b* formed on the gasket and the grooves 42, 44 and cut-outs 52*a*, 52*b* formed on the housing function as an interlocking means for securely mounting the gasket 10 to the housing 12 without the necessity of a separate fastening operation. In order to facilitate positioning or locating of the various rib members to the grooves and cut-outs, the gasket 10 is formed with a plurality of integral tabs 64 (one of which is shown in FIGS. 4 and 7) which are adapted to be press fitted into one of the openings 49 formed between the plurality of ledges 48 of the housing.

With particular reference to FIGS. 2–5, during automotive assembly the gasket 10 is initially attached by the assembler to the door handle housing 12 so that the tab 64 is tightly engaged with the opening 49. Then, the rib members 56 and 58 are pushed in so as to cause them to press fit into the respective grooves 42 and 44. Finally, the rib members 62*a*, 62*b* are pushed in so as to cause them to likewise press fit into the respective cut-outs 52*a*, 52*b*. Thereafter, the assembled housing and gasket is attached to the door panel 14 so that the surface 66 of the gasket is flush against the outer surface 68 (FIG. 3) of the door panel 12 adjacent the periphery of the recess 16 so as to effect a seal therebetween.

From the foregoing detailed description, it can thus be seen that the present invention provides an improved arrangement for mounting a gasket to a vehicle door handle housing without requiring the use of a separate fastening operation. Thus, the gasket can be easily and rapidly secured to the handle housing. The gasket is provided with rib members which tightly engage with grooves formed in the handle housing so as to securely mount the gasket to the housing.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims. It is therefore to be understood that within the scope of the appended claims, the present invention may be practiced otherwise than as specifically described herein.

What is claimed is:

1. An arrangement for mounting a gasket upon a vehicle door handle assembly, comprising:

a vehicle door handle housing including a body portion, and a peripheral portion surrounding said body portion, said peripheral portion of said handle housing including a groove formed within a central portion of said peripheral portion by being interposed between laterally spaced projecting rib portions; and an annular gasket including a projecting rib member which is formed upon a central portion of said annular gasket between laterally spaced shoulder portions of said annular gasket, said projecting rib member being dimensioned and contoured so as to be tightly engaged within said groove of said handle housing while said shoulder portions of said annular gasket overlie and engage said laterally spaced projecting rib portions of said handle housing peripheral portion so as to securely mount and support said annular gasket to and upon said handle housing.

2. The arrangement for mounting a gasket upon a vehicle door handle housing assembly as claimed in claim 1, wherein said groove includes a first arcuate-shaped groove portion extending substantially between a left side edge and a central portion of a bottom edge of said body portion, and a second elongated groove portion extending substantially between the central portion of the bottom edge and a right side edge of said body portion.

3. The arrangement for mounting a gasket upon a vehicle door handle housing assembly as claimed in claim 2, wherein said rib member includes a first arcuate-shaped rib portion which is adapted to be press fitted into said first groove portion and a second elongated rib portion which is adapted to be press fitted into said second groove portion.

4. The arrangement for mounting a gasket upon a vehicle door handle housing assembly as claimed in claim 3, further comprising cut-out means formed on a top edge of said peripheral portion and a third rib portion formed on the top edge of said gasket for tightly engaging said cut-out means.

5. The arrangement for mounting a gasket upon a vehicle door handle housing assembly as claimed in claim 1, further comprising positioning means formed on said handle housing and said gasket for facilitating their attachment.

6. The arrangement for mounting a gasket upon a vehicle door handle assembly housing as claimed in claim 5, wherein said positioning means includes at least one tab formed on said gasket and an opening formed on said housing for receiving said at least one tab.

7. The arrangement for mounting a gasket upon a vehicle door handle housing assembly as claimed in claim 1, wherein said housing is formed of a plastic material.

8. The arrangement for mounting a gasket upon a vehicle door handle housing assembly as claimed in claim 1, wherein said gasket is formed of an elastomeric material.

9. The arrangement for mounting a gasket upon a vehicle door handle housing assembly as claimed in claim 1, wherein said handle housing and said gasket are substantially elliptically-shaped in their configuration.

10. An arrangement for mounting a gasket upon a vehicle door handle assembly housing, comprising:

a vehicle door handle housing including a body portion, and a peripheral portion surrounding said body portion;

an annular gasket; and an interlocking means formed upon said door handle housing and said annular gasket for securely mounting said annular gasket upon said door handle housing;

said interlocking means including grooves formed within central portions of said peripheral portion of said housing by being interposed between laterally spaced projecting rib portions of said peripheral portion of said housing, and projecting rib member formed upon central portions of said annular gasket between laterally spaced shoulder portions of said annular gasket, said projecting rib members being dimensioned and contoured so as to be press fitted into said grooves of said handle housing while said shoulder portions of said annular gasket overlie and engage said laterally spaced projecting rib portions of said handle housing peripheral portion so as to securely mount and support said annular gasket to and upon said handle housing.

11. The arrangement as set forth in claim 10, wherein:

said grooves of said handle housing comprise a first arcuate-shaped groove extending substantially between a left side edge portion of said handle housing and a central portion of a bottom edge portion of said handle housing, and a second elongated groove extending substantially between said central portion of said bottom edge portion of said handle housing and a right side edge portion of said handle housing.

12. The arrangement as set forth in claim 11, wherein:

said projecting rib members of said annular gasket comprise a first arcuate-shaped rib member which is adapted to be press fitted within said first groove of said handle housing, and a second elongated rib member which is adapted to be press fitted within said second groove of said handle housing.

13. The arrangement as set forth in claim 12, further comprising:

cut-out means formed upon a top edge portion of said handle housing, and a third rib member formed upon a top edge portion of said annular gasket and adapted to be press fitted within said cut-out means of said handle housing.

14. The arrangement as set forth in claim 10, further comprising:

positioning means formed upon said handle housing and said annular gasket for facilitating power mounting of said annular gasket upon said handle housing.

15. The arrangement as set forth in claim 14, wherein:

said positioning means comprises at least one tab formed upon said annular gasket, and an opening formed within said handle housing for accommodating said at least one tab of said annular gasket.

16. The arrangement as set forth in claim 10, wherein:

said handle housing comprises a plastic material.

17. The arrangement as set forth in claim 10, wherein:

said annular gasket comprises an elastomeric material.

18. An arrangement for mounting a gasket upon a vehicle door handle assembly, comprising:

a vehicle door handle housing including a body portion, and a substantially planar peripheral portion surrounding said body portion, said peripheral portion of said handle housing including a plurality of circumferentially spaced grooved formed within central portions of said peripheral portion of said handle housing by being interposed between laterally spaced projecting rib portions; and a substantially planar annular gasket comprising laterally spaced shoulder portions which substantially define a plane of said substantially planar annular gasket from which a plurality of circumferentially spaced projecting rib members extend substantially perpendicularly with respect to said plane of said substantially planar annular gasket, said plurality of projecting rib members of said substantially planar annular gasket being formed upon a central portion of said annular gasket between said laterally spaced shoulder portions of said annular gasket and being contoured and dimensioned so as to be tightly engaged, respectively, within said plurality of circumferentially spaced grooves of said handle housing while said shoulder portions of said annular gasket overlie and engage said laterally spaced projecting rib portions of said handle housing peripheral portion so as to securely mount and support said annular gasket to and upon said handle housing.

19. The arrangement as set forth in claim 18, wherein:

said plurality of circumferentially spaced grooves of said handle housing comprise a first arcuate-spaced groove extending substantially between a left side edge portion of said handle housing and a central bottom edge portion of said handle housing, and a second elongated groove extending substantially between said central bottom edge portion of said handle housing and a right side edge portion of said handle housing.

20. The arrangement as set forth in claim 19, wherein:

said plurality of circumferentially spaced projecting rib members of said annular gasket comprise a first arcuate-shaped rib member which is adapted to be press fitted within said first groove of said handle housing, and a second elongated rib member which is adapted to be press fitted within said second groove of said handle housing.

21. The arrangement as set forth in claim 20, further comprising:

a third cut-out groove formed upon a top edge portion of said handle housing, and a third rib member formed upon a top edge portion of said annular gasket and adapted to be press fitted within said third cut-out groove of said handle housing.

22. The arrangement as set forth in claim 18, further comprising:

positioning means defined between said handle housing and said annular gasket for facilitating proper mounting of said annular gasket upon said handle housing as a result of engagement of said projecting rib members of said annular gasket within said grooves of said handle housing.

23. The arrangement as set forth in claim 22, wherein:

said positioning means comprises at least one tab formed upon said annular gasket, and an opening formed within said handle housing for accommodating said at least one tab of said annular gasket.

24. The arrangement as set forth in claim 18, wherein:

said handle housing comprises a plastic material; and said annular gasket comprises an elastomeric material.

* * * * *